United States Patent [19]

Peer et al.

[11] Patent Number: 4,940,532

[45] Date of Patent: Jul. 10, 1990

[54] CLEANUP OF HYDROCARBON CONVERSION SYSTEM

[75] Inventors: Roger L. Peer, LaGrange; Michael B. Russ, Elmhurst, both of Ill.

[73] Assignee: UOP, Des Plaines, Ill.

[21] Appl. No.: 413,143

[22] Filed: Sep. 27, 1989

[51] Int. Cl.[5] ..... C10G 35/09

[52] U.S. Cl. ..... 208/138; 208/134; 134/22.1; 134/22.12

[58] Field of Search ..... 208/135, 138, 46, 65; 134/22.1, 22.12

[56] References Cited

U.S. PATENT DOCUMENTS

| | | | |
|---|---|---|---|
| 2,662,041 | 12/1953 | Dougherty et al. | 134/22.1 |
| 2,742,398 | 4/1956 | Zobell | 134/22.1 |
| 2,792,337 | 5/1957 | Engel | 134/22.1 |
| 2,873,176 | 2/1959 | Hengstebeck | 23/288 |
| 2,902,434 | 9/1959 | Burton et al. | 208/134 |
| 3,003,948 | 10/1961 | Evans | 208/65 |
| 3,137,646 | 6/1964 | Capsuto | 208/65 |
| 3,438,888 | 4/1969 | Spurlock | 208/138 |
| 3,449,237 | 6/1969 | Jacobson et al. | 208/138 |
| 3,592,780 | 7/1971 | Rashkin | 208/138 |
| 3,705,096 | 12/1972 | McCaulay et al. | 208/65 |
| 3,992,282 | 11/1976 | Grosboll et al. | 208/46 |
| 4,155,836 | 5/1979 | Collins | 208/139 |
| 4,411,767 | 10/1983 | Garg | 208/10 |
| 4,456,527 | 6/1984 | Buss et al. | 208/89 |
| 4,507,397 | 3/1985 | Buss | 502/38 |
| 4,597,803 | 7/1986 | Stodolka | 134/22.1 |

*Primary Examiner*—Anthony McFarlane

*Attorney, Agent, or Firm*—Thomas K. McBride; John F. Spears, Jr.; Richard E. Conser

[57] ABSTRACT

A sacrificial particulate bed is utilized to remove contaminants, such as sulfur, from a conversion system. Subsequently, the sacrificial particulate bed is replaced by a contaminant-sensitive catalyst, such as a reforming catalyst selective for dehydrocyclization.

6 Claims, No Drawings

CLEANUP OF HYDROCARBON CONVERSION SYSTEM

BACKGROUND OF THE INVENTION

1. Field of the Invention

This invention relates to an improved process for the conversion of hydrocarbons, and more specifically for the catalytic reforming of gasoline-range hydrocarbons.

2. General Background

The catalytic reforming of hydrocarbon feedstocks in the gasoline range is an important commercial process, practiced in nearly every significant petroleum refinery in the world to produce aromatic intermediates for the petrochemical industry or gasoline components with high resistance to engine knock. Demand for aromatics is growing more rapidly than the supply of feedstocks for aromatics production. Moreover, the widespread removal of lead antiknock additive from gasoline and the rising demands of high-performance internal-combustion engines are increasing the required knock resistance of the gasoline component as measured by gasoline "octane" number. The catalytic reforming unit therefore must operate more efficiently at higher severity in order to meet these increasing aromatics and gasoline-octane needs. This trend creates a need for more effective reforming catalysts for application in new and existing process units.

Catalytic reforming generally is applied to a feedstock rich in paraffinic and naphthenic hydrocarbons and is effected through diverse reactions: dehydrogenation of naphthenes to aromatics, dehydrocyclization of paraffins, isomerization of paraffins and napthenes, dealkylation of alkylaromatics, hydrocracking of paraffins to light hydrocarbons, and formation of coke which is deposited on the catalyst. Increased aromatics and gasoline-octane needs have turned attention to the paraffin-dehydrocyclization reaction, which is less favored thermodynamically and kinetically in conventional reforming than other aromatization reactions. Considerable leverage exists for increasing desired product yields from catalytic reforming by promoting the dehydrocyclization reaction over the competing hydrocracking reaction while minimizing the formation of coke.

The effectiveness of reforming catalysts comprising a non-acidic L-zeolite and a platinum-group metal for dehydrocyclization of paraffins is well known in the art. The use of these reforming catalysts to produce aromatics from paraffinic raffinates as well as naphthas has been disclosed. The increased sensitivity to feed sulfur of these selective catalysts also is known. However, this dehydrocyclization technology has not been commercialized during the intense and lengthy development period. The extreme catalyst sulfur intolerance is believed to be the principal reason for this delay in commercialization. This catalyst may be deactivated rapidly in an existing reforming unit which previously employed a less-sulfur-sensitive catalyst for conversion of a sulfur-containing feed, since traces of sulfur contamination may remain in the process equipment even after conventional cleanup of the equipment. Existing reforming units could be reassigned for paraffin dehydrocyclization operations as large modern naphtha reforming units are constructed in conjunction with refinery modernizations. Therefore, an effective cleanup method is needed for these existing units as a concomitant to the reforming process for paraffin dehydrocyclization.

Related Art

Techniques are known in the art for avoiding deactivation of reforming catalysts by sulfur oxides produced from sulfur scale on the equipment during catalyst regeneration. U.S. Pat. No. 2,873,176 (Hengstebeck) discloses avoidance of an oxidizing atmosphere in equipment, other than reactors, which has been exposed to sulfur in the feedstock in order to avoid injury to the catalyst. U.S. Pat. No. 3,137,646 (Capsuto) teaches purging of sulfur from the lead heater of a catalytic reforming unit to the heater stock until $SO_2$ is not detected to avoid deterioration of the catalyst. U.S. Pat. No. 4,507,397 (Buss) reveals that controlling the water content of a regenerating gas to no more than 0.1 mol % in a catalytic reforming unit having sulfur-contaminated vessels avoids reaction of sulfur oxides with the catalyst. The above patents relate to protecting a reforming catalyst from sulfur scale during regeneration, in contrast to the present invention which addresses contaminants evolved during process operation. Further, the above patents do not disclose the use and replacement of a sacrificial particulate bed of the present invention to remove contaminants from the conversion system.

U.S. Pat. No. 4,155,836 (Collins, et al.) discloses that sulfur-contaminated reforming catalyst may have its activity restored by discontinuing the hydrocarbon feed and passing hydrogen and halogen over the catalsyt to reduce its sulfur concentration. U.S. Pat. No. 4,456,527 (Buss, et al.) teaches that a variety of sulfur-removal options may be used to reduce the sulfur content of a hydrocarbon feed to as low as 50 parts per billion for dehydrocyclization over a catalyst with high sulfur sensitivity. Buss, et al. thus recognizes the need for exceeding low sulfur to a reforming catalyst selective for dehydrocyclization. Neither of the above references, however, contemplates the use and removal of sacrificial particulate bed to remove contaminants from the conversion system of the present invention. A throw-away catalyst is known in the related art of coal conversion. U.S. Pat. No. 4,411,767 (Garg) teaches the use of an inexpensive throw-away catalyst for hydrogenation of solid solvent-refined coal, followed by recycle of the catalyst to the solvent-refining stag of coal conversion. Garg does not contemplate the removal of contaminants from the equipment of a conversion system by the use and replacement of a sacrificial particulate bed, however.

SUMMARY OF THE INVENTION

Objects

It is an object of the present invention to provide a hydrocarbon-conversion process for the effective use of a contaminant-sensitive catalyst in an existing system having contaminated equipment. A more specific objective is to obtain extended catalyst life for a dehydrocyclization catalyst used in an existing catalytic reforming system.

Summary

This invention is based on the discovery that removal of contaminants from equipment by contacting a hydrocarbon feed with a sacrificial particulate bed in a catalytic reforming system shows surprising benefits in extending the catalyst life of a contaminant-sensitive catalyst which subsequently replaces the sacrificial particulate bed in the same reforming system.

Embodiments

A broad embodiment of the present invention is a hydrocarbon-conversion process using a contaminant-sensitive catalyst, wherein contaminants are removed from a conversion system by contacting a first hydrocarbon feed with a sacrificial particulate bed followed by replacement of the particulate bed with the contaminant-sensitive catalyst which contacts a second hydrocarbon feed.

In a preferred embodiment, a first hydrocarbon feed is contacted with a first reforming catalyst in a catalytic reforming unit with sulfur-contaminated equipment followed by replacement of the first reforming catalyst with a second refroming catalyst effective for the dehydrocyclization of paraffins contained in a second hydrocarbon feed.

In an especially preferred embodiment, the sacrificial particulate bed comprises a sulfur sorbent.

These as well as other objects and embodiments will become apparent from the detailed description of the invention.

DESCRIPTION OF THE PREFERRED EMBODIMENTS

To reiterate, a broad embodiment of the present invention is a hydrocarbon-conversion process using a contaminant-sensitive catalyst, wherein contaminants are removed from a conversion system by contacting a first hydrocarbon feed with a sacrificial particulate bed followed by replacement of the particulate bed with the contaminant-sensitive catalyst which contacts a second hydrocarbon feed.

The conversion system of the present invention is an integrated processing unit which includes equipment, catalyst, sorbents and chemicals used in the processing of the hydrocarbon feedstock. The equipment includes reactors, reactor internals for distributing feed and containing catalyst, other vessels, heaters, heat exchangers, conduits, valves, pumps, compressors and associated components known to those of ordinary skill in the art. Preferably, the conversion system is a catalytic reforming system.

The conversion system comprises either a fixed-bed reactor or a moving-bed reactor whereby catalyst may be continuously withdrawn and added. These alternatives are associated with catalyst-regeneration options known to those of ordinary skill in the art, such as: (1) a semiregenerative unit containing fixed-bed reactors, which maintains operating severity by increasing temperature, eventually shutting the unit down for catalyst regeneration and reactivation; (2) a swing-reactor unit, in which individual fixed-bed reactors are serially isolated by manifolding arrangements as the catalyst becomes deactivated and the catalyst in the isolated reactor is regenerated and reactivated while the other reactors remain on-stream; (3) continuous regeneration of catalyst withdrawn from a moving-bed reactor, with reactivation and substitution of the reactivated catalyst, which permits higher operating severity by maintaining high catalyst activity through regeneration cycles of a few days; or, (4) a hybrid system with semiregenerative and continuous-regeneration provisions in the same unit. The preferred embodiment of the present invention is fixed-bed reactors in a semiregenerative unit.

The feed to the conversion system may contact the respective particulate bed or catalyst in the reactors in either upflow, downflow, or radial-flow mode. Since the preferred dehydrocyclization reaction is favored by relatively low pressure, the low pressure drop in a radial-flow reactor favors the radial-flow mode.

The contaminants comprise elements other than carbon or hydrogen, especially sulfur, nitrogen, oxygen or metals, which were deposited on the equipment of the conversion system in a precedent conversion process effected in the conversion system on a contaminant-containing prior feed previous to the execution of the present invention. A preferred example is sulfur introduced into the conversion system as sulfur compounds in a sulfur-containing prior feed to a precedent conversion process. Sulfur compounds decomposed in the precedent conversion operation may result in formation of metal sulfides, e.g., by reaction of hydrogen sulfide with internal surfaces of such equipment as heaters, reactors, reactor internals and conduits. Sulfur may be released from such sulfides in the process of the present invention, forming hydrogen sulfide which joins the reactants of the process. The amount of sulfur released may be minor relative to the reactants, particularly if the feed to the prior conversion process had been desulfurized or if the conversion system has been acidized or cleaned by other known chemical treatments prior to use in the process of the present invention. However, it has now been found that even minor amounts of sulfur can deactivate a catalyst selective for dehydrocyclization of paraffins, such as the second reforming catalyst described hereinafter.

In the present invention, the contaminants are removed from the conversion system by contacting a first hydrocarbon feed with a sacrificial particulate bed at contaminant-removal conditions in the conversion system. The first hydrocarbon feed preferably is substantially contaminant-free as defined hereafter. At contaminant-removal conditions, contaminants are released from equipment surfaces. By contacting the sacrificial particulate bed, contaminants released from equipment surfaces are either converted to a form more easily removable in the effluents from the conversion system, deposited on the particulate bed, or both converted and deposited on the bed. In a preferred embodiment, the conversion system comprises a catalytic-reforming system and small amounts of sulfur compounds in the feed and sulfur released from the equipment are converted to hydrogen sulfide by contact with a first reforming catalyst and the hydrogen sulfide is removed from the system by contact with a manganese oxide sorbent.

Contaminant removal may be effected to provide a contaminant-free conversion by charging the first hydrocarbon feed to the conversion system and withdrawing gaseous and liquid effluent from the system, by recycling gases and liquids from the exit to the entrance of the sacrificial particulate bed, or by a combination of withdrawing effluents and recycling gases or liquids. Contaminant removal is measured by testing the effluent streams from the conversion system for contaminant levels using test methods known in the art; in the absence of gaseous or liquid effluents, the combined feed and recycle to the sacrificial particulate bed is tested for contaminant levels. Contaminant removal is substantially complete when the measured level of contaminant, if contained in the second hydrocarbon feed as defined hereinafter, would not cause a shut down of the conversion system due to the deactivation of the contaminant-sensitive catalyst within a three-month period of operation. Preferably the level of contaminant will be below detectable levels, by test methods known in the art, when the conversion system is contaminant-free. A preferred embodiment comprises a sulfur-free catalytic-reforming system effected using a first reforming catalyst to transfer sulfur from contaminated equipment.

The sacrificial particulate bed is removed from the conversion system when contaminant removal is substantially complete and the conversion system thus is contaminant-free. The particulate bed may be reused in other processing, sent to component recovery, or discarded. The particulate bed is replaced with a contaminant-sensitive catalyst, which is contacted with a second hydrocarbon feed at hydrocarbon-conversion conditions. Preferably the contaminant-sensitive catalyst is a second reforming catalyst selective for dehydrocyclization of paraffins in the second hydrocarbon feed and is highly sensitive to sulfur, which has been removed from the conversion system by a first reforming catalyst.

Each of the first and second hydrocarbon feed comprises paraffins and naphthenes and may comprise olefins and mono- and polycyclic aromatics. The preferred first and second hydrocarbon feed boil within the gasoline range and may comprise gasoline, synthetic naphthas, thermal gasoline, catalytically cracked gasoline, partially reformed naphthas or raffinates from extraction of aromatics. The distillation range may be that of a full-range naphtha, having an initial boiling point typically from 40°-80° C. and a final boiling point of from about 150°-210° C., or it may represent a narrower range within these broad ranges. Paraffinic stocks, such as naphthas from Middle East crudes, are especially preferred second hydrocarbon feed due to the ability of the process to dehydrocyclize paraffins to aromatics. Raffinates from aromatics extraction, containing principally low-value $C_6$-$C_8$ paraffins which can be converted to valuable B-T-X aromatics, are especially preferred.

Each of the first and second hydrocarbon feed are substantially contaminant-free. Substantially contaminant-free is defined as a level of contaminant that, in the second hydrocarbon feed, would not cause a shut down of the conversion system due to the deactivation of the contaminant-sensitive catalyst within a three-month period of operation. Preferably the level of contaminant will be below detectable levels, by test methods known in the art. Each of the first hydrocarbon feed and the second hydrocarbon feed preferably has been treated by conventional methods such as hydrotreating, hydrorefining or hydrodesulfurization to convert sulfurous, nitrogenous and oxygenated compounds to $H_2S$, $NH_3$ and $H_2O$, respectively, which can be separated from the hydrocarbons by fractionation. This conversion preferably will employ a catalyst known to the art comprising an inorganic oxide support and metals selected from Groups VIB (6) and VIII (9-10) of the Periodic Table. [See Cotton and Wilkinson, *Advanced Organic Chemistry*, John Wiley & Sons (Fifth Edition, 1988)]. Alternatively or in addition to the conversion step, the feed may be contacted with sorbents capable of removing sulfurous and other contaminants. These sorbents may include but are not limited to zinc oxide, iron sponge, high-surface-area sodium, high-surface-area alumina, activated carbons and molecular sieves; excellent results are obtained with a nickel-on-alumina sorbent. In the preferred catalytic-reforming system, sulfur-free first and second hydrocarbon feeds have low sulfur levels disclosed in the prior art as desirable reforming feedstocks, e.g., 1 ppm to 0.1 ppm (100 ppb). Most preferably, the second hydrocarbon feed contains no more than 50 ppb sulfur.

Contaminant-removal conditions of the present invention include a pressure of from about atmospheric to 150 atmospheres (abs), a temperature of from about 200° to 600° C., and a liquid hourly space velocity relative to the sacrificial particulate bed of from about 0.2 to 40 $hr^{-1}$. The removal of sulfur from the equipment, as the preferred contaminant, is preferably effected at first reforming conditions in the presence of a first reforming catalyst. It is especially preferred that sulfur removal is effected in the presence of a sulfur sorbent, and best results are obtained when the sacrificial particulate bed comprises both a first reforming catalyst and a sulfur sorbent. First reforming conditions comprise a pressure of about atmospheric to 60 atmospheres (abs), an operating temperature generally in the range of 260° to 560° C., and a liquid hourly space velocity of from about 1 to 40 $hr^{-1}$. Hydrogen is supplied to this preferred reforming operation in an amount to correspond to a ratio of from about 0.1 to 10 moles of hydrogen per mole of first hydrocarbon feed.

Following replacement of the sacrificial particulate bed with the contaminant-sensitive catalyst, the contaminant-sensitive catalyst contacts the second hydrocarbon feed at hydrocarbon-conversion conditions. Hydrocarbon-conversion conditions comprise a pressure of from about atmospheric to 150 atmospheres (abs), a temperature of from about 200° to 600° C., and a liquid hourly space velocity relative to the contaminant-sensitive catalyst of from about 0.2 to 10 $hr^{-1}$. Preferably these conditions comprise second reforming conditions including a pressure of from about atmospheric to 60 atmospheres (abs). More preferably the pressure is from atmospheric to 20 atmospheres (abs), and excellent results have been obtained at operating pressures of less than 10 atmospheres. The hydrogen to hydrocarbon mole ratio is from about 0.1 to 10 moles of hydrogen per mole of second hydrocarbon feed. Space velocity with respect to the volume of contaminant-sensitive catalyst is from about 0.5 to 10 $hr^{-1}$. Operating temperature is from about 400° to 560° C. Since the predominant reaction of the preferred embodiment is the dehydrocyclization of paraffins to aromatics, the contaminant-sensitive catlyst will preferably be contained in two or more reactors with interheating between reactors to compensate for the endothermic heat of reaction and maintain suitable temperature for dehydrocyclization.

The sacrificial particulate bed, as mentioned hereinabove, serves to convert contaminants to a form more easily removable from the conversion system, to receive contaminants deposited on the bed, or to both convert and receive contaminants. The sacrificial particulate bed comprises an aggregate of macroparticles having a narrowest characteristic dimension through the center of each particle of between about 400 and about 3200 microns. The particles may be of any suitable shape including one or more of extrudates, spheres, pills, granules, cokes or powders.

A preferred sacrificial particulate bed is a first reforming catalyst, which is a dual-function composite containing a metallic hydrogenation-dehydrogenation component on a refractory support which provides acid sites for cracking and isomerization. This catalyst functions preferably to convert small amounts of sulfur in the feedstock and released from the equipment to $H_2S$ in order to preclude sulfur from contacting the contaminant-sensitive catalyst. The sacrificial reforming catalsyt would tolerate episodes of up to about 10 ppm of sulfur in the feedstock with substantial recovery of activity. The sacrificial reforming catalyst also preferably effects some dehydrogenation of naphthenes in the feedstock as well as, to a lesser degree, isomerization, cracking and dehydrocyclization.

The refractory support of the first reforming catalyst should be a porous, adsorptive, high-surface-area material which is uniform in composition without composition gradients of the species inherent to its composition. Within the scope of the present invention are refractory support containing one or more of: (1) refractory inorganic oxides such as alumina, silica, titania, magnesia, zirconia, chromia, thoria, boria or mixtures thereof; (2) synthetically prepared or naturally occurring clays and silicates, which may be acid-treated; (3) crystalline zeolitic aluminosilicates, either naturally occurring or synthetically prepared such as FAU, MEL, MFI, MOR, MTW (IUPAC Commission on Zeolite Nomenclature), in hydrogen form or in a form which has been exchanged with metal cations; (4) spinels such as $MgAl_2O_4$, $FeAl_2O_4$, $ZnAl_2O_4$, $CaAl_2O_4$; and (5) combinations of materials from one or more of these groups. The preferred refractory support for the first reforming catalyst is alumina, with gamma- or eta-alumina being particularly preferred. Best results are obtained with "Ziegler alumina," described in U.S. Pat. No. 2,892,858 and presently available from the Vista Chemical Company under the trademark "Catapal" or from Condea Chemie GmbH under the trademark "Plural." Ziegler alumina is an extremely high-purity pseudoboehmite which, after calcination at a high temperature, has been shown to yield a high-priority gamma-alumina. It is especially preferred that the refractory inorganic oxide comprise substantially pure Ziegler alumina having an apparent bulk density of about 0.6 to 1 g/cc and a surface area of about 150 to 280 $m^2/g$ (especially 185 to 235 $m^2/g$) at a pore volume of 0.3 to 0.8 cc/g.

The alumina powder may be formed into any shape or form of carrier material known to those skilled in the art such as spheres, extrudates, rods, pills, pellets, tablets or granules. Spherical particles may be formed by converting the aluminum metal into alumina sol by reaction with suitable peptizing acid and water and dropping a mixture of the resulting sol and gelling agent into an oil bath to form spherical particles of an alumina gel, followed by known aging, drying and calcination steps. The preferred extrudate form is preferably prepared by mixing the alumina powder with water and suitable peptizing agents, such as nitric acid, acetic acid, aluminum nitrate and like materials, to form an extrudable dough having a loss on ignition (LOI) at 500° C. of about 45 to 65 mass %. The resulting dough is extruded through a suitably shaped and sized die to form extrudate particles, which are dried and calcined by known methods. Alternatively, sphereical particles can be formed from the extrudes by rolling the extrudate particles on a spinning disk.

An essential component of the preferred first reforming catalyst is one or more platinum-group metals, with a platinum component being preferred. The platinum may exist within the catalyst as a compound such as the oxide, sulfide, halide, or oxyhalide, in chemical combination with one or more other ingredients of the catalytic composite, or as an elemental metal. Best results are obtained when substantially all of the platinum exists in the catalytic composite in a reduced state. The platinum component generally comprises from about 0.01 to 2 mass % of the catalytic composite, preferably 0.05 to 1 mass %, calculated on an elemental basis. It is within the scope of the present invention that the catalyst known to modify the effect of the preferred platinum component. Such metal modifiers may include Group IVA (14) metals, other Group VII (8–10) metals, rhenium, indium, gallium, zinc, uranium, dysprosium, thallium and mixtures thereof. Excellent results are obtained when the first reforming catalyst contains a tin component. Catalytically effective amounts of such metal modifiers may be incorporated into the catalyst by any means known in the art.

The first reforming catalyst of the present invention may contain a halogen component. The halogen component may be either fluorine, chlorine, bromine or iodine or mixtures thereof. Chlorine is the preferred halogen component. The halogen component is generally present in a combined state with the inorganic-oxide support. The halogen component is preferably well dispersed throughout the catalsyt and may comprise from more than 0.2 to about 15 wt %. calculated on an elemental basis, of the final catalyst.

An optional ingredient of the first reforming catalyst is an L-zeolite. It is within the ambit of the present invention that the same catalyst may be used as the first and second reforming catalysts. The volume of first reforming catalyst loaded in the reactors of the conversion system nevertheless is less than the volume of second reforming catalsyt.

The first reforming catalyst generally will be dried at a temperature of from about 100° to 320° C. for about 0.5 to 24 hours, followed by oxidation at a temperature of about 300° to 550° C. in an air atmosphere for 0.5 to 10 hours. Preferably the oxidized catalyst is subjected to a substantially waterfree reduction step at a temperature of about 300° to 550° C. for 0.5 to 10 hours or more. Further details of the preparation and activation of embodiments of the sacrificial reforming catalyst are disclosed in U.S. Pat. No. 4,677,094 (Moser et al.), which is incorporated into this specification by reference thereto.

The especially preferred sacrificial particulate bed comprises a sulfur sorbent, preferably a manganese component. Best results are obtained with manganese oxide. Manganese oxide has been found to provide reforming catalyst protection superior to the zinc oxide of the prior art, it is believed, due to possible zinc contamination of downstream reforming catalyst. Manganese oxide comprises one or more of MnO, $Mn_3O_4$, $Mn_2O_3$, $MnO_2$, $MnO_3$, and $Mn_2O_7$. The especially preferred manganese oxide is MnO (manganous oxide). The manganese component may be composited with a suitable binder such as clays, graphite, or inorganic oxides including one or more of alumina, silica, zirconia, magnesia, chromia or boria. Preferably, the manganese component is unbound and consists essentially of manganese oxide. Even more preferably the manganese component consists essentially of MnO, which has demonstrated excellent results for sulfur removal and has shown adequate particle strength without a binder for the present invention.

The contaminant-sensitive catalyst used in hydrocarbon conversion comprises one or more metal components on a refractory support. The metal component will comprise one or more from Groups IA (1), IIA (2), IVA (4), VIA (6), VIIA (7), VIII (8–10), IIIB (13) or IVB (14) of the Periodic Table. Applicable refractory supports are as described hereinabove. The contaminant-sensitive catalyst also may contain a halogen component, phosphorus component, or sulfur component.

The contaminant-sensitive catalyst preferably is a second reforming catalyst containing a non-acidic L-zeolite and a platinum-group metal component, which is highly sulfur-sensitive. It is essential that the L-zeolite be non-acidic, as acidity in the zeolite lowers the selectivity to aromatics of the finished catalyst. In order to be "non-acidic," the zeolite has substantially all of its cationic exchange sites occupied by nonhydrogen species. More preferably the cations occupying the exchangeable cation sites will comprise one or more of the alkali metals, although other cationic species may be present. An especially preferred nonacidic L-zeolite is potassium-form-L-zeolite.

It is necessary to composite the L-zeolite with a binder in order to provide a convenient form for use in the catalyst of the present invention. The art teaches that any refractory inorganic oxide binder is suitable. One or more of silica, alumina or magnesia are preferred binder materials of the second reforming catalyst. Amorphous silica is especially preferred, and excellent results are obtained when using a synthetic white silica powder precipitated as ultra-fine spherical particles from a water solution. The silica binder preferably is nonacidic, contains less than 0.3 mass % sulfate salts, and has a BET surface area of from about 120 to 160 $m^2/g$.

The L-zeolite and binder may be composited to form the desired catalyst shape by any method known in the art. For example, potassium-form L-zeolite and amorphous silica may be commingled as a uniform powder blend prior to introduction of a peptizing agent. An aqueous solution comprising sodium hydroxide is added to form an extrudable dough. The dough preferably will have a moisture content of from 30 to 50 mass % in order to form extrudates having acceptable integrity to withstand direct calcination. The resulting dough is extruded through a suitably shaped and sized die to form extrudate particles, which are dried and calcined by known methods. Alternatively, spherical particles may be formed by methods described hereinabove for the first reforming catalyst.

The platinum-group component is another essential feature of the second reforming catalyst, with a platinum component being preferred. The platinum may exist within the catalyst as a compound such as the oxide, sulfide, halide, or oxyhalide, in chemical combination with one or more other ingredients of the catalytic composite, or as an elemental metal. Best results are obtained when substantially all of the platinum exists in the catalytic composite in a reduced state. The platinum component generally comprises from about 0.05 to 5 mass % of the catalytic composite, preferably 0.05 to 2 mass %, calculated on an elemental basis. It is within the scope of the present invention that the catalyst may contain other metal components known to modify the effect of the preferred platinum component. Such metal modifiers may include Group IVA (14) metals, other Group VIII(8–10) metals, rhenium, indium, gallium, zinc, uranium, dysprosium, thallium and mixtures thereof. Catalytically effective amounts of such metal modifiers may be incorporated into the catalyst by any means known in the art.

The final second reforming catalyst generally will be dried at a temperature of from about 100° to 320° C. for about 0.5 to 24 hours, followed by oxidation at a temperature of about 300° to 550° C. (preferably about 350° C.) in an air atmosphere for 0.5 to 10 hours. Preferably the oxidized catalyst is subjected to a substantially water-free reduction step at a temperature of about 300° to 550° C. (preferably about 350° C.) for 0.5 to 10 hours or more. The duration of the reduction step should be only as long as necessary to reduce the platinum, in order to avoid pre-deactivation of the catalyst, and may be performed in-situ as part of the plant startup if a dry atmosphere is maintained. Further details of the preparation and activation of embodiments of the second reforming catalyst are disclosed, e.g., in U.S. Pat. Nos. 4,619,906 (Lambert et al.) and 4,882,762 (Ellig et al.), which are incorporated into this specification by reference thereto.

EXAMPLES

The following examples are presented to demonstrate the present invention and to illustrate certain specific embodiments thereof. These examples should not be construed to limit the scope of the invention as set forth in the claims. There are many possible other variations, as those of ordinary skill in the art will recognize, which are within the spirit of the invention.

The examples illustrate the feasibility and advantage of removing sulfur from a conversion system in the manner disclosed in the present invention.

EXAMPLE 1

The capability of a combination of a reforming catalyst and an MnO sulfur sorbent in series to achieve a substantially sulfur-free effluent from a naphtha feedstock was determined.

The platinum-tin-alumina reforming catalyst used in this determination had the following composition in mass %:

| | |
|---|---|
| Pt | 0.38 |
| Sn | 0.30 |
| Cl | 1.06 |

The manganous oxide consisted essentially of MnO in spheroidal pellets with over 90% in the size range of 4–10 mesh. Equal volumes of reforming catalyst and MnO were loaded in series with the reforming catalyst above the MnO. The sulfur-removal capability of this combination was tested by processing a hydrotreated naphtha spiked with thiophene to obtain a sulfur concentration of about 2 mass parts per million (ppm) in the feed. The naphtha feed had the following additional characteristics:

| | | |
|---|---|---|
| Sp.gr. | | 0.7447 |
| ASTM D-86, °C. | IBP | 80 |
| | 50% | 134 |
| | EP | 199 |

The naphtha was charged to the reactor in a downflow operation, thus contacting the reforming catalyst and MnO successively. Operating conditions were as follows:

| | |
|---|---|
| Pressure, atmospheres | 8 |

-continued

| | |
|---|---|
| Temperature, °C. | 371 |
| Hydrogen/hydrocarbon, mol | 3 |
| Liquid hourly space velocity, $hr^{-1}$ | 10* |

*On total loading of catalyst + MnO

Over the 13-day testing period, there was no detectable sulfur in the liquid or vapor products. Adjusting ASTM D 4045 repeatability for laboratory experience, the product sulfur level was reported as less than 14 parts per billion (ppb). The combination of a platinum-tin-alumina catalyst ahead of a bed of manganous oxide thus was able to treat naphtha th a sulfur contact higher than would be obtained by standard hydrotreating to yield a product containing no detectable sulfur.

Over a 50-day testing period, there was no detectable $H_2S$ in the off-gas with ending feed sulfur content at 4.3 mass ppm. Sulfur in the liquid product was below detectable limits by the ASTM D 4045 test during days 42–46 with feed sulfur at 2.6 mass ppm. Thereafter, product sulfur increased to an average of about 110 mass parts per billion (ppb) with feed sulfur at 4.3 mass ppm.

The sulfur content of the MnO bed was measured as follows in mass % at the end of the test:

| | |
|---|---|
| Upper bed | 11.40 |
| Lower bed | 4.64 |

Therefore, the combination of a platinum-tin-alumina catalyst ahead of a bed of manganous oxide was able to isolate sulfur from a reforming system with a substantial loading of sulfur on MnO sorbent.

EXAMPLE II

The economic benefit of the present invention in a conversion system was calculated for a catalytic reforming unit based on the following assumptions:

| | |
|---|---|
| Capacity, barrels/stream day | 10,000 |
| Liquid hourly space velocity | 1.5 |
| Catalyst volume, cubic meters | 44 |

Sulfur removal is effected from the equipment of the unit using the following catalyst loadings in cubic meters:

| | |
|---|---|
| First reforming catalyst $Pt/Sn/Al_2O_3$ | 3.3 |
| Sulfur sorbent: MnO | 3.3 |

Costs for the sulfur-removal operation were estimated as follows:

| | | |
|---|---|---|
| Initial cost of catalyst + sorbent: | | |
| First reforming catalyst: 3.3 $m^3$ × \$11,000/$m^3$ | = | \$33,000 |
| Sulfur sorbent: 3.3 $m^3$ × \$32,000/$m^3$ | = | 105,600 |
| Total initial catalyst + sorbent cost | | \$138,600 |
| Operating cost, 30 days, @ \$1/barrel | | 300,000 |
| Total cost | | \$438,600 |

Any credit for increased product value or hydrogen, or a spent catalyst or sorbent credit, would reduce the net cost.

The cost of a loading of contaminant-sensitive second reforming catalyst is estimated as follows:

Second reforming catalyst: 44 $m^3$ @ \$30,000/$m^3$=\$1,320,000

Thus, the cost of protecting the contaminant-sensitive catalyst from rapid deactivation could be one-third or less of the cost of the loading of contaminant-sensitive catalyst.

We claim:

1. In a process for the catalytic reforming of a substantially contaminant-free second hydrocarbon feed using a second reforming catalyst, in a catalytic-reforming system having equipment contaminated through contact with a contaminant-containing prior feed, the improvement comprising:
   (a) contacting the first hydrocarbon feed in the catalytic-reforming system at first reforming conditions with a first reforming catalyst until contaminant removal from the conversion system is substantially completed and the system is contaminant-free; thereafter
   (b) replacing the first reforming catalyst in the contaminant-free catalytic-reforming system with a second reforming catalyst; and thereafter
   (c) contacting the second hydrocarbon feed in the contaminant-free catalytic-reforming system with the second reforming catalyst at second reforming conditions.

2. The process of claim 1 wherein the second reforming catalyst comrpises a platinum-group metal component.

3. The process of claim 2 wherein the platinum-group metal comprises platinum.

4. The process of claim 1 wherein the second reforming catalyst comprises a non-acidic L-zeolite.

5. In a process for the catalytic reforming of a substantially sulfur-free second hydrocarbon feed, using a contaminant-sensitive catalyst in equipment contaminated through contact with a prior sulfur-containing feed, the improvement comprising:
   (a) contacting a first hydrocarbon feed in the catalytic-reforming system at contaminant-removal conditions with a first reforming catalyst and a sulfur sorbent until sulfur transfer from the equipment to the sulfur sorbent is substantially completed and the system is sulfur-free; thereafter
   (b) replacing tyhe first reforming catalyst and the sulfur sorbent in the sulfur-free catalytic-reforming system with a second reforming catalyst; and thereafter
   (c) contacting the second hydrocarbon feed in the sulfur-free catalytic-reforming system at catalytic-reforming conditions with the second reforming catalyst.

6. In a process for the catalytic reforming of a substantially sulfur-free second hydrocarbon feed, using a contaminant-sensitive catalyst, in a catalytic-reforming system having equipment contaminated through contact with a prior sulfur-containing feed, the improvement comprising:
   (a) contacting a first hydrocarbon feed in the catalytic-reforming system at contaminant-removal conditions with a first reforming catalyst and a manganese oxide until sulfur transfer from the equipment to the manganese oxide is substantially completed and the system is sulfur-free; thereafter
   (b) replacing a first reforming catalyst and the manganese oxide in the catalytic-reforming system with a second reforming catalyst selective for dehydrocyclization of paraffins; and thereafter
   (c) contacting the second hydrocarbon feed in the sulfur-free catalytic-reforming system at catalytic reforming conditions with a second reforming catalyst.

* * * * *